US005267504A

United States Patent [19]

Weyer

[11] Patent Number: 5,267,504

[45] Date of Patent: Dec. 7, 1993

[54] ROTARY ACTUATOR WITH ANNULAR FLUID COUPLING ROTATABLY MOUNTED TO SHAFT

[76] Inventor: Paul P. Weyer, P.O. Box 398, Enumclaw, Wash. 98022

[21] Appl. No.: 856,093

[22] Filed: Mar. 20, 1992

Related U.S. Application Data

[60] Continuation-in-part of Ser. No. 787,682, Nov. 4, 1991, abandoned, which is a continuation-in-part of Ser. No. 640,051, Jan. 11, 1991, abandoned, and a continuation-in-part of Ser. No. 717,906, Jun. 19, 1991, Pat. No. 5,158,420, which is a division of Ser. No. 504,308, Apr. 6, 1990, Pat. No. 5,071,310.

[51] Int. Cl.[5] ..... F01B 3/00

[52] U.S. Cl. ..... 92/31; 92/33

[58] Field of Search ..... 92/31, 32, 33, 54, 55, 92/164

[56] References Cited

U.S. PATENT DOCUMENTS

| | | | |
|---|---|---|---|
| 3,477,345 | 11/1969 | Johnson | 92/31 X |
| 3,687,014 | 8/1972 | Forster et al. . | |
| 4,313,367 | 2/1982 | Weyer . | |
| 4,342,257 | 8/1982 | Weyer | 92/31 |
| 4,422,366 | 12/1983 | Weyer | 92/33 X |
| 4,667,528 | 5/1987 | Weyer | 74/424.8 |
| 4,683,767 | 8/1987 | Weyer | 74/409 |
| 4,741,250 | 5/1988 | Weyer | 92/33 |
| 4,748,866 | 6/1988 | Weyer | 74/424.8 |
| 4,838,103 | 6/1989 | Weyer | 74/89.15 |
| 4,858,486 | 8/1989 | Weyer | 74/409 |
| 4,881,419 | 11/1989 | Weyer | 74/89.15 |
| 4,945,778 | 8/1990 | Weyer . | |
| 4,960,007 | 10/1990 | Weyer | 74/89.15 |
| 4,987,825 | 1/1991 | Weyer | 92/31 X |

FOREIGN PATENT DOCUMENTS

| | | | |
|---|---|---|---|
| 1426525 | 5/1969 | Fed. Rep. of Germany | 92/33 |
| 1939158 | 2/1971 | Fed. Rep. of Germany | 92/33 |
| 2115707 | 2/1972 | Fed. Rep. of Germany | 92/33 |
| 2456878 | 8/1976 | Fed. Rep. of Germany | 92/33 |
| 911726 | 11/1962 | United Kingdom | 92/55 |

*Primary Examiner*—Edward K. Look
*Assistant Examiner*—John Ryznic
*Attorney, Agent, or Firm*—Seed and Berry

[57] ABSTRACT

A fluid-powered rotary actuator attachable to a boom and usable with a work implement having two hydraulic actuators. The rotary actuator has a body with a drive shaft extending longitudinally therewithin. The shaft has one end located outward of the body and fixed to an attachment flange which can be connected to a vehicle boom. An annular fluid coupling is rotatably mounted on the shaft between the flange and the body. Fluid passageways in the shaft conduct fluid to the coupling, which has three circumferential fluid distribution channels. The coupler provides the fluid to flexible hoses which extend to the hydraulic actuators. The coupling is freely rotatable relative to the shaft but has a connection finger attached thereto which is received in a hole in a connection flange which is attached to the body. The connection flange transmits a rotational force on the coupling through the finger as the body rotates to produce rotation of the coupling with the body, but the receiving hole is sufficiently larger than the finger positioned therein that axial and bending forces are not transmitted between the body and the coupling. A set of annular body and shaft inserts is positioned at each end of the body to rotatably support the body on the shaft.

17 Claims, 3 Drawing Sheets

ROTARY ACTUATOR WITH ANNULAR FLUID COUPLING ROTATABLY MOUNTED TO SHAFT

CROSS-REFERENCE TO RELATED APPLICATIONS

This application is a continuation-in-part of U.S. application Ser. No. 07/787,682, filed Nov. 4, 1991, now which is a continuation-in-part of U.S. application Ser. No. 07/640,051, filed Jan. 11, 1991, now abandoned; and is a continuation-in-part of U.S. application Ser. No. 07/717,906, filed Jun. 19, 1991, now U.S. Pat. No. 5,158,420, which is a division of U.S. application Ser. No. 07/504,308, filed Apr. 6, 1990, now U.S. Pat. No. 5,071,310.

TECHNICAL FIELD

The present invention relates generally to actuators, and more particularly, to fluid-powered rotary tool actuators in which axial movement of a piston results in rotational movement of a body relative to a stationary shaft, with the body movement being used to selectively rotate a tool.

BACKGROUND OF THE INVENTION

Rotary helical splined actuators have been employed in the past to achieve the advantage of high-torque output from a simple linear piston-and-cylinder drive arrangement. The actuator typically uses a cylindrical body with an elongated rotary shaft extending coaxially within the body, with an end portion of the shaft or the body providing the drive output. An elongated annular piston sleeve has a sleeve portion splined to cooperate with corresponding splines on the body interior and the shaft exterior. The piston sleeve is reciprocally mounted within the body and has a head for the application of fluid pressure to one or the other opposing sides thereof to produce axial movement of the piston sleeve.

As the piston sleeve linearly reciprocates in an axial direction within the body, the outer splines of the sleeve portion engage the splines of the body to cause rotation of the sleeve portion. The resulting linear and rotational movement of the sleeve portion is transmitted through the inner splines of the sleeve portion to the splines of the shaft to cause the shaft to rotate relative to the body. Bearings are typically supplied to rotatably support one or both ends of the shaft relative to the body.

While such an arrangement produces a relatively high-torque output, the capability of the actuator to support high moment loads and large axial and radial thrust loads has been limited. The actuator typically has a slender shaft with bearings between the shaft and end flanges or end caps of the body, with the bearings positioned radially inward of the body sidewall. It is desirable to use rotary actuators to rotate heavy tools, such as grapples and shears, which are subjected to large loads.

The conventional rotary actuator is not well constructed to handle the high moments often encountered when used as a tool actuator. Further, the axial thrust loads encountered due to the weight of the tool, and the load it carries, may be too great for conventional actuator bearing configurations.

Another problem involves the cost of manufacturing actuators, especially ones designed to handle high moments and large axial and radial loads. As shown in the inventor's U.S. Pat. No. 4,881,419, in the past the actuator body has been designed with a thick wall construction, and since the bearing races are formed in the body sidewall of the actuator, the body must be hardened. The result is a heavy and expensive body. Even in lighter load applications where a thin-wall body construction is used, end caps with a plurality of the rods extending therebetween are often needed.

When using a rotary actuator to carry a tool, such as a grapple or a shear which operates on pressurized hydraulic fluid, delivering the fluid to the hydraulically operated cylinders which operate the moveable arms of the grapple or the movable jaw of the shear becomes difficult. With a grapple, it is desirable to have the actuator shaft fixedly attached to an attachment head which can be carried at the end of a boom arm of a vehicle, with the arms of the grapple pivotally attached to the actuator body. The movement of each arm may be accomplished using a hydraulically operated cylinder which extends between the arms and the actuator body to cause the arms to pivot relative to the body. In such manner, the arms of the grapple can be caused to open and close. Since the actuator body is rotated on the fixed actuator shaft, and thus relative to the attachment head to which the shaft is fixedly attached, it becomes difficult to supply pressurized hydraulic fluid to the cylinders which operate the grapple arms.

Use of flexible pressure hoses to carry the hydraulic fluid from the source of pressurized hydraulic fluid, usually supplied by a pump mounted on the vehicle, requires that hoses extend along the vehicle's boom arm and then to the cylinders. While each hose can be provided with a large loop of hose to allow for the rotation of the actuator body and the grapple arms attached thereto without twisting of the hoses, such loops of hose can become entangled or snag on obstacles while the grapple is being operated. This can result in pinching or breaking of the hoses. Of course, when this occurs the operator must untangle the hoses or, if damaged, replace them, resulting in unproductive time. Further, if a hose is broken, the loss of hydraulic pressure might cause the grapple to drop the load being carried, resulting in damage.

In the inventor's earlier U.S. Pat. No. 4,342,257 showing a tool actuator, a coupling block is used to provide the fluid connection between a tool attached to the end of the actuator shaft and the coupling block. The coupling block is rigidly connected by bolts to a stationary body which is affixed to a boom attachment head. A hydraulically operated cylinder is connected between the coupling block and the boom of a vehicle carrying the actuator. While this arrangement provided an improvement over the prior art, during operation of the tool, the forces applied to the coupling block by the cylinder to move the assembly about, and forces on the shaft that produced as the tool was operated, caused undesirable movement between the coupling block and the shaft. This resulted in difficulty in achieving a good fluid seal between the coupling block and the shaft and increased seal wear.

It will therefore be appreciated that there has long been a significant need for fluid-powered rotary actuators capable of handling increased moments and axial and radial shaft loads. The actuator should have a compact and lightweight design which allows use of a thin wall body construction without requiring use of tie rods. The actuator should be economical to manufacture. Further, the actuator should provide a convenient means for transmitting fluid pressure between a vehicle-carried pressurized fluid source and a tool which is attached to a rotatable actuator body with minimum resulting seal wear and improved sealing to eliminate leakage of pressurized fluid. The present invention fulfills these needs and further provides other related advantages.

DISCLOSURE OF THE INVENTION

The present invention resides in a fluid-powered rotary actuator attachable to a carrier and usable with a work implement having a selectively operable work implement actuator associated therewith. The work implement actuator has a pair of fluid ports for operation of the work implement actuator in response to selective application of pressurized fluid thereto from a source of pressurized fluid remote from the rotary actuator. The actuator has an attachment member configured for attachment to the carrier. The actuator further has a body with a longitudinal axis, and first and second ends, and a shaft extending longitudinally and generally coaxially within the body.

The body has a first attachment portion configured for attachment of the work implement thereto for rotation with the body, and a second attachment portion configured for attachment of the work implement actuator thereto for application of a counterforce upon actuation of the work implement actuator to operate the work implement. The shaft has first and second end portions. The shaft first end portion is located toward the body first end and extends axially outward beyond the body first end, and is attached to the attachment member at a position axially outward of the body first end in a manner to prevent rotation of the shaft relative to the attachment member. The shaft first end portion has an outward surface portion. In the illustrated embodiment of the invention, the attachment member has a central aperture and the shaft first end portion extends therethrough and terminates in a shaft end surface. The shaft first and second source ports are positioned at the shaft end surface.

The actuator also has an annular fluid coupling rotatably mounted on the shaft first end portion between the attachment member and the body first end. The coupling has a central aperture defined by an inward surface portion extending circumferentially about the shaft outward surface portion, with the shaft first end portion extending fully through the coupling central aperture. The coupling is freely rotatable on the shaft first end portion. At least one of the coupling inward surface portion or the shaft outward surface portion has first and second circumferentially extending fluid distribution channels formed therein. The coupling further has first and second fluid conduits, with the coupling first conduit being in fluid communication with the first fluid distribution channel and the coupling second conduit being in fluid communication with the second fluid distribution channel. The coupling first and second conduits terminate in first and second fluid ports, respectively, with each connectable to one of the pair of work implement actuator ports. In the illustrated embodiment of the invention, the coupling has a circumferentially extending outward surface, with the coupling first and second fluid ports being positioned at the coupling outward surface.

In the illustrated embodiment, the actuator has a first connection member attached to the coupling and a second connection member attached to the body. The second connection member engages the first connection member to transmit a rotational force on the coupling as the body rotates on the shaft to produce rotation of the coupling on the shaft first end portion with the body, without transmitting axial or bending forces between the body and the coupling. In the illustrated embodiment of the invention, one of the first or second connection members is a connector finger projecting generally parallel to the body axis toward the other of the first or second connection member, and the other of the first or second connection member has an aperture loosely receiving a portion of the connector finger therein to transmit rotational force through the first connector finger to the coupling as the body rotates. The connection member aperture is sized sufficiently larger than the finger portion to permit unrestricted relative axial movement therebetween and free movement of the finger portion within the connector aperture resulting from axial movement of the body on the shaft or bending of the shaft or the body during operation.

A shaft first fluid conduit extends from a first source port through the shaft first end portion and terminates in a shaft first port in the shaft outward surface portion. The shaft first port is in alignment with the first fluid distribution channel and remains in fluid communication therewith as the coupling rotates on the shaft first end portion. The first source port is connectable to the source of pressurized fluid. A shaft second fluid conduit extends from a second source port through the shaft first end portion and terminates in a shaft second port in the shaft outward surface portion. The shaft second port is in alignment with the second fluid distribution channel and remains in fluid communication therewith as the coupling rotates on the shaft first end portion. The second source port is connectable to the source of pressurized fluid.

In the illustrated embodiment of the invention, the actuator has a first annular shaft insert mounted coaxially within the body toward the body first end. The first shaft insert has a central aperture, with the first shaft end portion extending therethrough. The first shaft insert further has a generally cylindrical outer surface and an axially inward annular end portion with a circular ball race formed thereon. A second annular shaft insert is mounted coaxially within the body toward the body second end. The second shaft insert has a central aperture, with the second shaft end portion extending therethrough. The second shaft insert further has a generally cylindrical outer surface and an axially inward annular end portion with a circular ball race formed thereon.

A first body insert has a sleeve portion mounted coaxially within the body toward the body first end about the first shaft insert. The cylindrical outer surface of the first shaft insert is positioned within a central aperture of the first body insert. The first body insert has a circumferential flange portion projecting generally radially inward from the first body insert sleeve portion beyond the first shaft insert cylindrical outer surface to overlap the first shaft insert annular end portion. The first body insert flange portion is positioned axially inward of the first shaft insert ball race. The first body insert flange portion has a circular ball race formed thereon confronting and corresponding to the first shaft insert ball race to form a first set of races extending circumferentially about the first shaft end portion at a radial location inward of the cylindrical outer surface of the first shaft insert and rotatably supports the body toward the body first end for rotational movement of the body relative to the shaft.

Similarly, a second body insert has a sleeve portion mounted coaxially within the body toward the body second end about the second shaft insert. The cylindrical outer surface of the second shaft insert is positioned within a central aperture of the second body insert. The second body insert has a circumferential flange portion projecting generally radially inward from the second body insert sleeve portion beyond the second shaft insert cylindrical outer surface to overlap the second shaft insert annular end portion. The second body insert flange portion is positioned axially inward of the second shaft insert ball race. The second body insert flange portion has a circular ball race formed thereon confronting and corresponding to the second shaft insert ball race to form a second set of races extending circumferentially about the second shaft end portion at a radial location inward of the cylindrical outer surface of the second shaft insert and rotatably supporting the body toward the body second end for rotational movement of the body relative to the shaft. One or more balls are seated in each of the first and second sets of races.

A first seal is positioned in a circumferential groove in the first shaft insert cylindrical outer surface to provide a fluid-tight seal between the first shaft insert and the first body insert. A second seal is positioned in a circumferential groove in the second shaft insert cylindrical outer surface to provide a fluid-tight seal between the second shaft insert and the second body insert.

A third seal axially positioned between the first and second fluid distribution channels provides a fluid-tight seal between the coupling and the shaft first end portion. Fourth and fifth seals are axially positioned with the first and second fluid distribution channels therebetween. The fourth and fifth seals provide fluid-tight seals between the coupling and the shaft first end portion.

A piston is mounted for reciprocal longitudinal movement within the body in response to selective application of pressurized fluid thereto. A torque-transmitting member is mounted for reciprocal longitudinal movement within the body. The torque-transmitting member engages the body and the shaft to translate longitudinal movement of the piston toward one of the body first or second ends into clockwise rotational movement of the body on the shaft, and longitudinal movement of the piston toward the other of the body first or second ends into counterclockwise rotational movement of the body on the shaft.

Other features and advantages of the invention will become apparent from the following detailed description, taken in conjunction with the accompanying drawings.

BEST MODE FOR CARRYING OUT THE INVENTION

Figure 1:
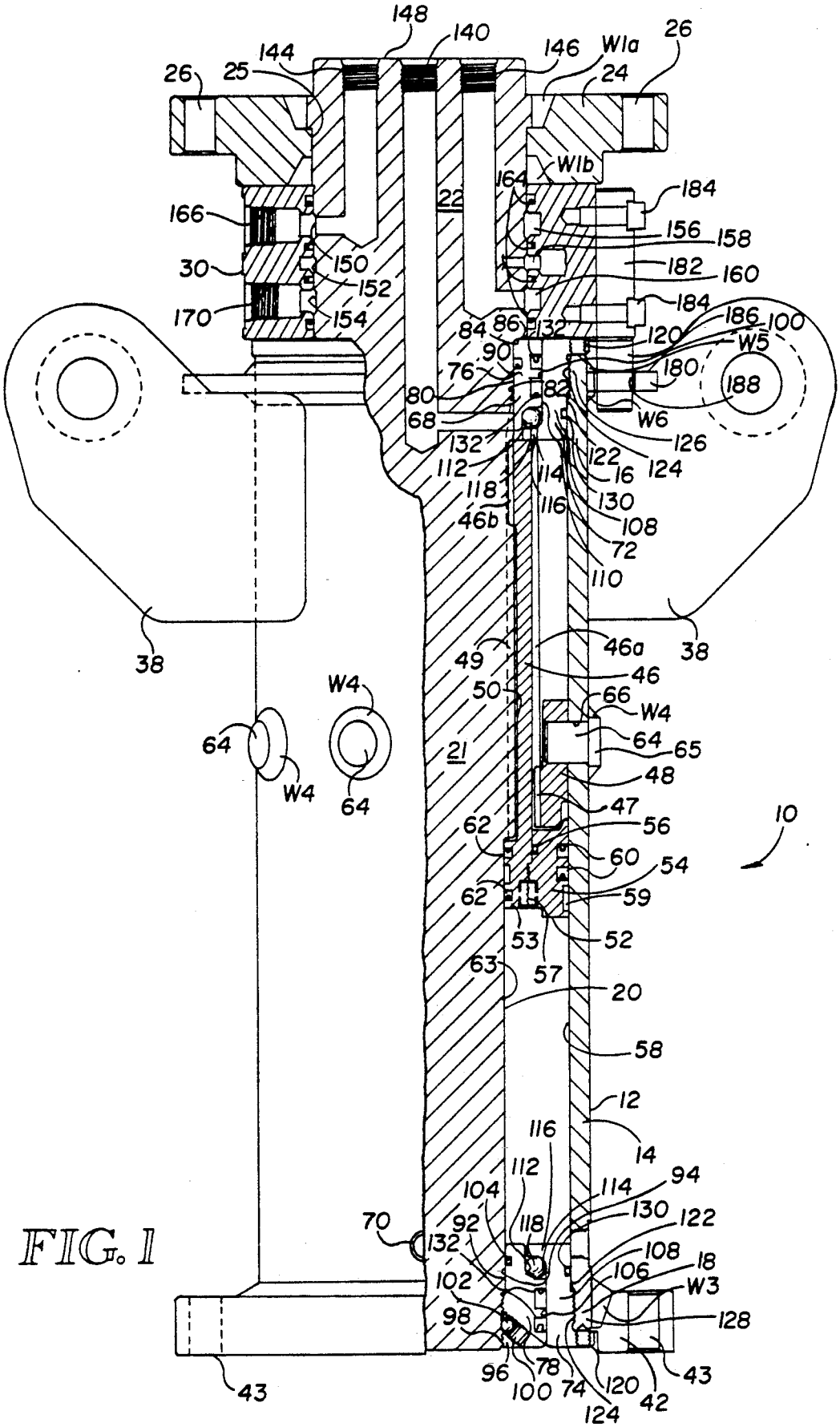
FIG. 1 is a fragmentary, side elevational, sectional view of a fluid-powered rotary splined actuator embodying the present invention.
Figure 2:
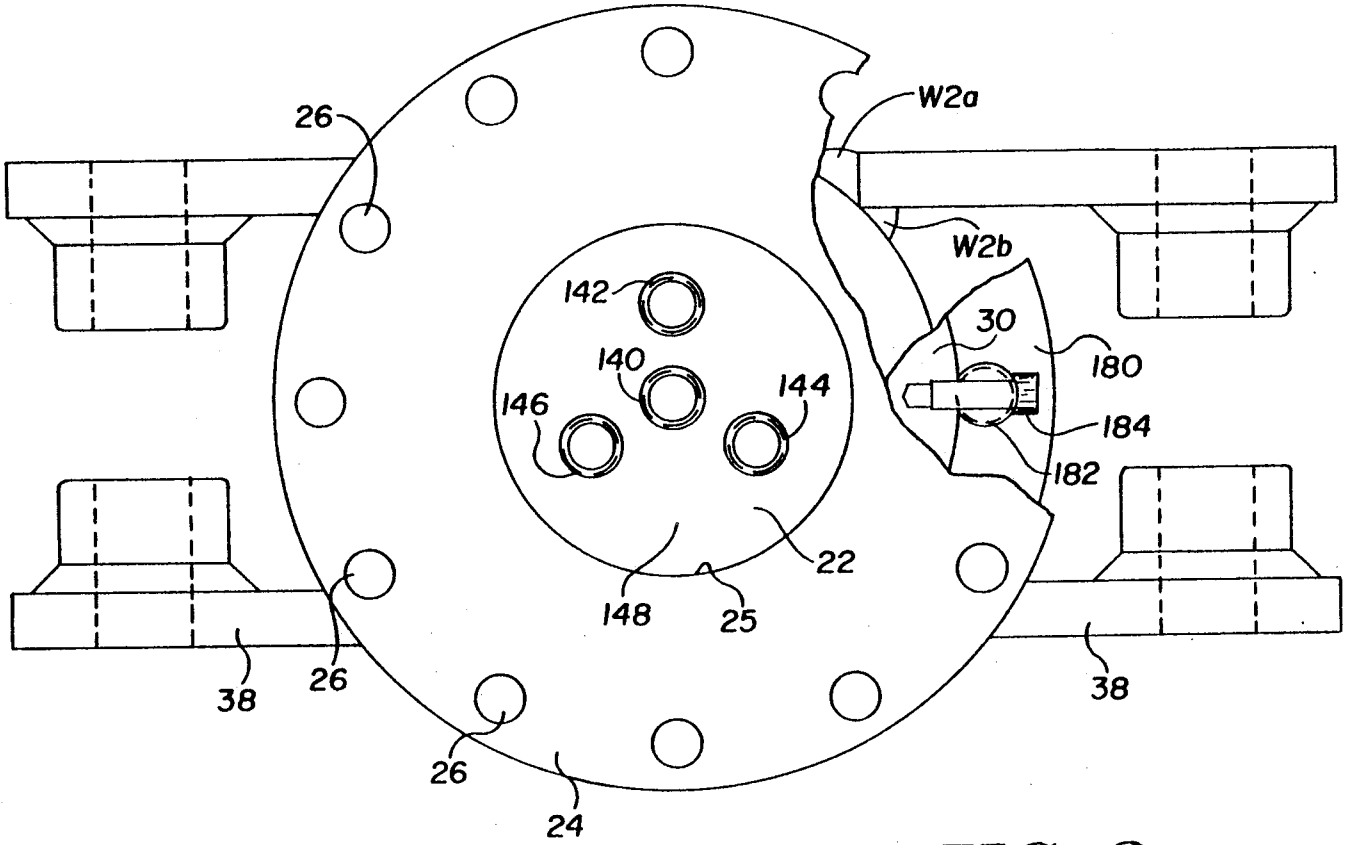
FIG. 2 is a fragmentary, top plan view of the actuator of FIG. 1.

As shown in the drawings for purposes of illustration, the present invention is embodied in a fluid-powered rotary actuator 10. The actuator 10 includes an elongated housing or body 12 having a cylindrical sidewall 14 and first and second ends 16 and 18, respectively. A shaft 20 is coaxially positioned within the body 12 and the body is supported on the shaft for rotation relative to the shaft, as will be described in more detail below.

Figure 3:
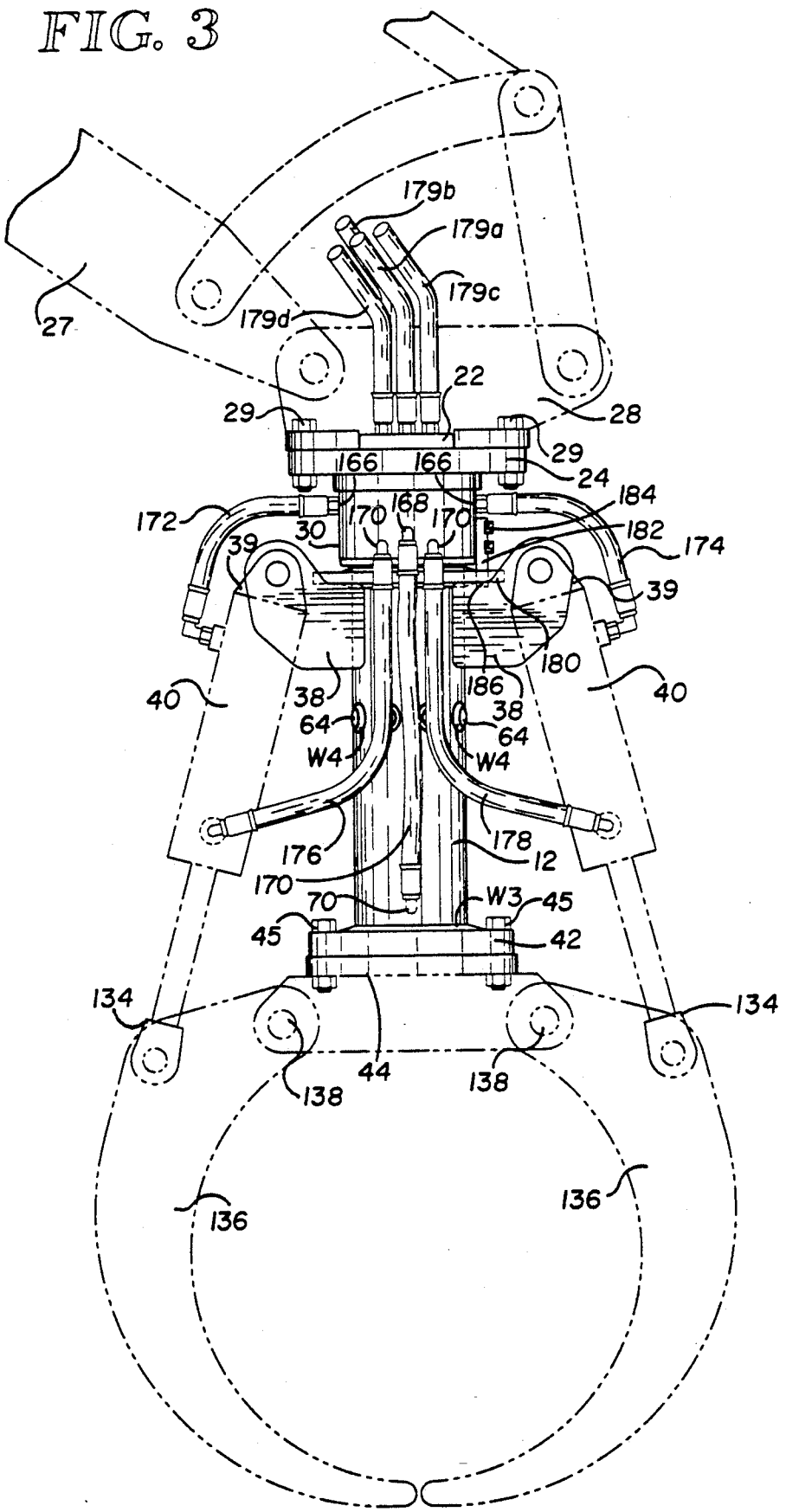
FIG. 3 is a side elevational sectional view of the actuator of FIG. 1 with a pair of grapple arms pivotally mounted to the actuator body and the actuator shaft attached to a boom attachment head.

The shaft 20 includes an elongated portion 21 axially extending substantially the full length of the body 12 and an end portion 22 which extends beyond the body at the body first end 16. A radially outward projecting mounting flange 24 has a central aperture 25 which receives the shaft end portion 22 therein. The shaft flange 24 is fixedly attached to the shaft end portion 22 by circumferential welds **W1*a* and W1*b* at a position spaced axially away from the body first end 16. The shaft flange 24 has a plurality of holes 26 circumferentially spaced thereabout for coupling to an attachment head 28 using a plurality of fastening bolts 29, such as shown in FIG. 3. The attachment head 28 may be connected to a boom arm 27 of a vehicle (not shown) carrying the actuator 10. Rotatably positioned on the shaft end portion 22 between the body first end 16 and the shaft flange 24 for uninhibited rotation relative to the shaft is a fluid coupling or gland 30, which will be described in more detail below. The invention is practiced with the shaft 20 being held stationary relative to the attachment head 28, and rotational drive being provided by rotation of the body 12** relative to the shaft.

The body 12 has two clevises 38 attached thereto by welds **W2*a* and W2*b*. The clevises 38 are located toward the body first end 16 and projecting outward from opposite sides of the body. Each of the clevises 38 has a first end 39 of one of a pair of hydraulically operated cylinders 40 pivotally attached, as shown in FIG. 3. The body 12 also has a radially outward projecting mounting flange 42 fixedly attached thereto toward the body second end 18 by a circumferential weld W3. The body flange 42 has a plurality of holes 43 circumferentially spaced thereabout for coupling of a tool mounting bracket 44 thereto, as shown in FIG. 3, for rotation with the body 12. The tool mounting bracket 44 is fixed to the body flange 42 by a plurality of fastening bolts 45**.

The actuator 10 has a conventional linear-to-rotary transmission means which includes an annular piston sleeve 46 which is reciprocally mounted within the body 12 coaxially about the elongated portion 21 of the shaft 20. The piston sleeve 46 has outer helical splines **46*a* over a portion of its length which mesh with inner helical splines 47 of a ring gear 48. The piston sleeve 46 is also provided with inner helical splines 46*b* which mesh with outer helical splines 49 provided on a splined intermediate portion 50 of the shaft portion 21**. It should be understood that while helical splines are shown in the drawings and described herein, the principle of the invention is equally applicable to any form of linear-to-rotary motion conversion means, such as balls or rollers.

In the illustrated embodiment of the invention, the piston sleeve 46 has an annular two-piece piston 52 positioned toward the body second end 18. The piston 52 is formed of an inner head portion 53 and an outer piston ring 54 which extends about the head portion and is threadably attached thereto. A seal 56 disposed between the head portion 53 and the piston ring 54 provides a fluid-tight seal therebetween, and a setscrew 57 locks the piston ring in place against rotation on the head portion 53. The piston 52 is slidably maintained within the body 12 for reciprocal movement, and undergoes longitudinal and rotational movement relative to a smooth interior wall surface 58 of the body sidewall 14, as will be described in more detail below. A radial bearing 59 is carried by the piston ring 54 which bears against the interior wall surface 58.

Two axially spaced-apart seals 60 are disposed between the piston ring 54 and the interior wall surface 58 of the body 12 to provide a fluid-tight seal therebetween. Two axially spaced-apart seals 62 are disposed between the head portion 53 and a smooth exterior wall surface 63 of the shaft portion 21 to provide a fluid-tight seal therebetween.

The ring gear 48 is joined to the body 12 by a plurality of pins 64 which are uniformly positioned about the body sidewall 14 and extend through a plurality of ring gear fastening holes 66 in the sidewall. The pins 64 are welded to the body sidewall 14. The pins 64 each have a head portion 65 which is attached to the body sidewall 14 by a circumferential weld W4.

As will be readily understood, reciprocation of the piston 52 within the body 12 occurs when hydraulic oil, air or any other suitable fluid under pressure selectively enters through a first port 68 to one side of the piston toward the body first end 16 or through a second port 70 to the other side of the piston toward the body second end 18. As the piston 52, and the piston sleeve 46 of which the piston is a part, linearly reciprocates in an axial direction within the body 12, the outer helical splines 49 of the intermediate portion 50 of the shaft portion 21 engage or mesh with the inner helical splines **46*b* of the piston sleeve 46 to cause rotation of the piston sleeve. The linear and rotational movement of the piston sleeve 46 is transmitted through the outer helical splines 46*a* of the piston sleeve to the inner helical splines 47 of the ring gear 48 to cause the body 12 to rotate relative to the shaft 20. The longitudinal movement of the body 12 on the shaft 20 is restricted, thereby converting all movement of the piston sleeve 46 into rotational movement of the body 12. Depending on the slope and direction of turn of the various helical splines, there may be provided a multiplication of the rotary output of the body 12**.

The application of fluid pressure to the port 68 produces axial movement of the piston sleeve 46 toward the body second end 18. The application of fluid pressure to the port 70 produces axial movement of the piston sleeve 46 toward the body first end 16. The actuator 10 provides rotational movement of the body 12 relative to the shaft 20 through the conversion of linear movement of the piston sleeve 46 into rotational movement of the body, in a manner well known in the art. The illustrated embodiment of the actuator 10 produces 360 degrees of body rotation relative to the shaft 20 and 45,000 inch-pounds of torque at 3,000 psi hydraulic fluid pressure.

The body 12 is constructed from a relatively thin-walled metal tube which has not been hardened and which is fabricated using a low-carbon weldable steel. With a body 12 so constructed, the clevis 38 and the body flange 42 can be conveniently welded directly to the body. As with the body 12, the shaft 20 is fabricated using a low-carbon weldable steel so that the shaft flange 24 can be conveniently welded directly to the shaft.

In the past, at least one or the other of the body or shaft of rotary actuators has been fabricated from a hardened steel to permit the cutting of ball bearing races therein. Since welds made to high-carbon hardened steel do not stand up well under large loads, such as are encountered with rotary actuators, mounting flanges and clevises could not be welded directly to both the body and shaft since one or both was made of high-carbon steel. This made attachment of the actuator to the device being driven and to the structure supporting the actuator more difficult and expensive than desired, and increased the overall cost of manufacture of the actuator. The actuator 10 of the present invention eliminates the need to fabricate either the body or the shaft from high-carbon steel with ball bearing races cut therein. As such, the body 12 can be constructed from an inexpensive, low-carbon weldable steel tube with a smooth interior bore. This eliminates machining except the honing necessary to provide smooth body interior wall surfaces for seals, and to size and finish the interior wall surfaces for positioning of a ring gear 48 therein. With the use of a simple tube for the body 12, all these operations can be conducted at one time using a single honing step to finish the entire interior body wall surface.

The actuator 10 includes first and second annular body inserts 72 and 74, respectively, and first and second annular shaft inserts 76 and 78, respectively. The first shaft insert 76 is positioned on the shaft 20 at the body first end 16 and, as with the shaft, is stationary and has a circumferential interior surface 80 defining a central aperture 82 which receives the shaft portion 21 therethrough. An axially outward end portion 84 of the first shaft insert 76 engages a shoulder 86 formed in the shaft 20 axially inward of the fluid gland 30 to prevent axial movement of the first shaft insert 76 toward the body first end 16 under axial loading on the shaft flange 24 in a direction toward the body second end 18. A seal is disposed in a groove 90 cut into the interior surface 80 of the first shaft insert 76 to provide a fluid-tight seal between the first shaft insert and the shaft portion 21.

The second shaft insert 78 is positioned on the shaft 20 at the body second end 18 and, as with the shaft, is stationary and has a circumferential interior surface 92 defining a central aperture 94 which receives the shaft portion 21 therethrough. The interior surface 92 includes an interiorly threaded portion 96 which is threadably received on a correspondingly threaded exterior end portion 98 of the shaft portion 21 at the body second end 18. The second shaft insert 78 is locked in place on the shaft 20 against rotation relative thereto by a setscrew 100 which holds a lock ball 102 in a groove in the shaft portion 21, thereby preventing axial movement of the second shaft insert 78 under axial loading. A seal is disposed in a groove 104 cut into the interior surface 92 of the second shaft insert 78 to provide a fluid-tight seal between the second shaft insert and the shaft portion 21.

Each of the first and second body inserts 72 and 74 is of identical construction and has a central aperture 106 and an annular sidewall portion 108. The first body insert 72 is coaxially positioned within the body 12 at the body first end 16, and has its central aperture 106 sized to rotatably receive the first shaft insert 76 therein. The first shaft insert 76 has a circumferential exterior surface 110 and the annular sidewall portion 108 of the first body insert 72 is positioned within the annular space between the first shaft insert exterior surface 110 and the body sidewall 14 at the body first end 16.

An exterior ball race 112 is formed on an axially inward end portion of the first shaft insert 76, and an interior ball race 114 is formed on a circumferential flange portion 116 of the first body insert 72 confronting and corresponding to the first shaft insert ball race 112. The first shaft insert and first body insert ball races 112 and 114 extend circumferentially, fully about the first shaft insert 76 and form a first set of races. A plurality of steel ball bearings 118 are seated in the first set of races and rotatably support the first body insert 72 for rotational movement of the body 12 relative to the shaft 20.

The first body insert flange portion 116 projects radially inward from the first body insert sidewall portion 108 beyond the circumferential exterior surface 110 of the first shaft insert 76 to overlap a portion of the axially inward end portion on which the ball race 112 is formed. By forming the first body insert ball race 114 on the first body insert flange portion 116, and not on the first body insert sidewall portion 108, construction of the first body insert sidewall portion with the smallest possible wall thickness is achieved to permit the largest possible diameter for the first shaft insert 76 and hence the largest possible pitch diameter for the first set of races. This design provides increased stability against high moment loads that can produce shaft tilting.

The first body insert flange portion 116 is positioned axially inward from the axially inward end portion of the first shaft insert 76, but adjacent thereto. When the actuator 110 is oriented in a vertical position with the body first end 16 above the body second end 18, the first body insert flange portion 116 extends radially inward beyond the circumferential exterior surface 110 of the first shaft insert 76 so as to be positioned under the ball bearings 118. The first body insert flange portion 116 provides the necessary load carrying capability without requiring a large wall thickness for the first body insert sidewall portion 108, even when a need exists in a particular application to increase the diameter of the ball bearings 118.

The second body insert 74 is coaxially positioned within the body 12 at the body second end 18, and has its central aperture 106 sized to rotatably receive the second shaft insert 78 therein. The second shaft insert 78 and the second body insert 74 cooperate in the same manner described above for the first shaft insert 76 and the first body insert 72, and serve to support the shaft 20 against moment loads and both radial and axial thrust loads.

The first and second body inserts 72 and 74 and the first and second shaft inserts 76 and 78 are hardened to withstand the wear of the ball bearings 118 on their ball races during fluid-powered use of the actuator 10. By the use of four hardened inserts, it is no longer necessary to form the ball races directly on either the body sidewall 14 or the shaft 20, as has been done in the past. This allows the use of a thinner-walled and less expensive body 12. With the present invention, the body 12 may be fabricated from an unhardened, thin-walled, metal tube, to produce a lightweight, less expensive actuator. This also eliminates the need to harden the shaft 20 and allows the use of an unhardened metal for the shaft. Further, since the ball races formed on the first and second shaft inserts 76 and 78 and on the first and second body inserts 72 and 74 can be machined before the inserts are positioned on the shaft 20 and in the body 12, the fabrication process is less difficult and more economical than in the past when the ball races had to be machined directly on the shaft and body sidewall.

The first and second body inserts 72 and 74 each have a circumferential outwardly extending flange 120 positioned exterior of the body 12 and projecting outward beyond the corresponding body first or second end 16 or 18. The flanges 120 engage the corresponding body endwalls of the body sidewall 14 at the body first and second ends 16 and 18 to prevent axial movement of the first body insert 72 toward the body second end 18 and axial movement of the body second insert 74 toward the body first end 16 during fluid-powered operation of the actuator 10. Each of the flanges 120 has a setscrew which engages the corresponding body endwall to prevent rotation of the first and second body inserts 72 and 74 relative to body 12 during fluid-powered operation.

The first and second body inserts 72 and 74 each have a circumferential exterior surface 122 with a threaded portion 124. The body insert threaded portion 124 of the first insert 72 is threadably received by a corresponding threaded interior portion 126 of the body sidewall 14 at the body first end 16, and the body insert threaded portion 124 of the second body insert 74 is threadably received by a correspondingly threaded interior portion 128 of the body sidewall at the body second end 18 to prevent axial movement of the inserts during fluid-powered operation of the actuator 10.

Each of the first and second body inserts 72 and 74 has a seal disposed in a groove 130 cut into the exterior surface 122 thereof to provide a fluid-tight seal between the first and second shaft inserts and the body sidewall 14. A pair of seals are disposed in a pair of grooves 132 cut into of the exterior surfaces 110 of the first and second shaft inserts 76 and 78 to provide a fluid-tight seal between the first shaft insert 76 and the first body insert 72, and between the second shaft insert 78 and the second body insert 74. The seals prevent fluid leakage from the body 12.

Because the sidewall portions 108 of the first and second body inserts 72 and 74 have such narrow wall thickness, the first and second shaft inserts 76 and 78 extend radially outward so as to fully overlap the ball bearings 118. This results in significantly more material being present in the area of the first and second shaft inserts 76 and 78 axially outward of the ball races 112, and permits the cutting of the seal grooves 132 in the shaft inserts for receiving seals without overly weakening the shaft inserts by the cutting of the grooves. Thus, there is no need to cut the grooves for the seals in the sidewall portions 108 of the first and second body inserts 72 and 74 and thereby require an increase in their wall thickness to accommodate the grooves. As a result of the use of body insert flange portions 116, which allow the construction of narrow sidewall body inserts and provide the maximum possible diameter for the shaft inserts, the ball races 112 and 114 and the seal grooves 132 need not be formed in the first and second body insert sidewall portions 108.

Since the design of the first and second body inserts 72 and 74 provides large pitch diameters for the sets of races formed by the ball races 112 and 114, the load-carrying ability of the actuator 10 is enhanced, and the actuator is able to handle the radial and axial thrust loads and the large moments encountered by the shaft 20. This is achieved with a very compact, lightweight, and economical actuator construction.

As previously described, the second shaft insert 78 is threadably received on the threaded exterior end portion 98 at the body second end 18 of the shaft portion 21. By adjustably rotating the second shaft insert 78 prior to commencing fluid-powered operation of the actuator 10, the second shaft insert can be axially positioned within the body 12 on the shaft portion 21 relative to the first and second body inserts 72 and 74 to preload the ball bearings 118 seated in the ball races 112 and 114.

As shown in FIG. 3, each of the hydraulically operated cylinders 40 has a second end 134 pivotally attached to one of a pair of grapple arms 136. Each of the grapple arms 136 is pivotally attached to the tool mounting bracket 44 by a pin 138 spaced apart from the point of attachment of the second ends of the cylinders 40 to the grapple arms. The grapple arms 136 are oriented so that the extension and retraction of the cylinders 40 cause the grapple arms to pivot between a closed position as shown in FIG. 3 f or carrying of a load, and an open position for release of the load. It should be understood that while the invention is described with a pair of grapple arms 136 being carried by the tool mounting bracket 44, other tools such as a shear can be used. In the case of a shear, the fixed jaw of the shear would be rigidly attached to the tool mounting bracket 44, and the movable jaw of the shear would be pivotally attached to the tool mounting bracket and moved by operation of one of the cylinders 40 in generally the same manner as shown in FIG. 3 for each of the grapple arms 136. Of course, other tools besides grapple arms and shears can be attached to the tool mounting bracket 44 and pivoted relative thereto by use of a cylinder 40 connected between at least one clevis 38 and the movable tool portion.

Since the body 12 rotates relative to the shaft 20 as the piston 52 moves longitudinally within the body and responds to the application of fluid pressure selectively to either the port 68 or the port 70, it is necessary to deliver pressurized hydraulic fluid to these ports and to the hydraulically operated cylinders 40 which operate the movable grapple arms 136. As shown in FIG. 1, the end portion 22 of the shaft 20 is constructed of solid steel and has four hydraulic fluid passageways P1, P2, P3 and P4 bored therein and terminating at threaded hose connectors 140, 142, 144 and 146, respectively, located at an end wall 148 of the shaft end portion (only passageways P1, P3 and P4 being shown in FIG. 1). The passageway P1 is centrally located and extends longitudinally within the shaft end portion 22 from the hose connector 140 to a position radially inward from the port 68, and turns radially outward to communicate with the port 68 to supply hydraulic fluid to the side of the piston 52 toward the body first end 16. Hydraulic fluid could be supplied to the other side of the piston 52 toward the body second end 18 using a similar passageway extending between the shaft end wall 148 longitudinally through substantially the entire length of the shaft 20, however, in the illustrated embodiment of the invention the hydraulic fluid is supplied through the fluid gland 30.

The shaft end portion 22 has longitudinally spaced-apart first, second and third grooves 150, 152 and 154, respectively, formed in an exterior surface of the shaft end portion 22 which extend circumferentially fully about the shaft end portion exterior surface and conduct hydraulic fluid, as will be described below. The shaft grooves 150, 152 and 154 are positioned inward of the fluid gland 30, which has longitudinally spaced-apart first, second and third grooves 156, 158 and 160, respectively, formed in an interior surface thereof which extend circumferentially fully about the gland interior surface and conduct hydraulic fluid. The shaft first groove 150 is in alignment with the fluid gland first groove 156 to define a first circumferential fluid distribution channel, the shaft second groove 152 is in alignment with the fluid gland second groove 158 to define a second circumferential fluid distribution channel, and the shaft third groove 154 is in alignment with the fluid gland third groove 160 to define a third circumferential fluid distribution channel.

Four circumferential grooves 164 are cut into the interior surface of the fluid gland 30, with one groove to each side of each of the fluid gland first, second and third grooves 156, 158 and 160. A seal is disposed in each of the grooves 164 so as to provide a fluid-tight seal between the fluid gland 30 and the shaft end portion 22 to prevent leakage of fluid from and between the first, second and third fluid distribution channels.

The fluid gland 30 has a pair of radially extending, threaded hose connectors 166 formed in the fluid gland, and each is in fluid communication with the first fluid distribution channel. The fluid gland 30 has a radially extending, threaded hose connector 168 formed in the fluid gland, and which is in fluid communication with the second fluid distribution channel. The fluid gland 30 also has a pair of radially extending, threaded hose connectors 170 formed in the fluid gland, and each is in fluid communication with the third fluid distribution channel.

The passageway P2 (not shown in FIG. 1) extends longitudinally within the shaft end portion 22 from the hose connector 142 and turns radially outward to terminate at the shaft first groove 150 so as to be in fluid communication with the first fluid distribution channel. Similarly, the passageway P3 extends longitudinally within the shaft end portion 22 from the hose connector 144 and turns radially outward to terminate at the shaft second groove 152 so as to be in fluid communication with the second fluid distribution channel. The passageway P4 extends longitudinally within the shaft end portion 22 from the hose connector 146 and turns radially outward to terminate at the shaft third groove 154 so as to be in fluid communication with the third fluid distribution channel. With the foregoing arrangement of the three passageways P2, P3 and P4 in constant fluid connection with the first, second and third fluid distribution channels defined by the mating sets of grooves in the shaft end portion and the fluid gland, hydraulic fluid from a pressurized source (not shown) can be distributed to the side of the piston 52 toward the body second end 18 and to the two cylinders 40 which operate the grapple arms 136 as the body 12 rotates.

As illustrated in FIG. 3, a flexible hydraulic hose 170 is connected between the fluid gland connector 168 and the threaded port 70 to supply hydraulic fluid to the side of the piston 52 toward the body second end 18. In similar fashion, a flexible hydraulic hose 172 is connected between one of the fluid gland connectors 166 and the extension port of the one cylinder 40 to supply hydraulic fluid thereto to extend its arm and pivot the grapple arm 136 to which it is connected toward the closed position. Another flexible hydraulic hose 174 is connected between the other of the fluid gland connectors 166 and the extension port of the other cylinder 40 to supply hydraulic fluid thereto to extend its arm and pivot the other grapple arm 136 to which it is connected toward the closed position. A flexible fluid hose 176 is connected between one of the fluid gland connectors 170 and the retraction port of the one cylinder 40 to retract the cylinder's arm and pivot the grapple arm 136 to which it is connected toward the open position. Likewise, a flexible fluid hose 178 is connected between the other of the fluid gland connectors 170 and the retraction port of the other cylinder 40 to retract the cylinder's arm and pivot the grapple arm 136 to which it is connected toward the open position.

Since the hoses 172 and 174 connected to the extension ports of the two cylinders 40 are both in fluid communication with the first fluid distribution channel, and hence the passageway P3, the application of fluid pressure to the passageway P3 will cause both of the cylinders to extend simultaneously. Similarly, since the hoses 176 and 178 connected to the retraction ports of the two cylinders 40 are both in fluid communication with the third fluid distribution channel, and hence the passageway P4, the application of fluid pressure to the passageway P4 will cause both of the cylinders to retract simultaneously. As a result, both grapple arms 136 open and close in unison. Of course, if a shear or another tool connected to the tool mounting bracket 44 includes only one movable tool portion, only a single cylinder and two hoses would be required for operation of the tool.

As shown in FIG. 3, flexible fluid hoses 179*a*, 179*b*, 179*c* and 179*d* are connected between the hose connectors 140, 142, 144 and 146, respectively, located in the end wall 148 of the shaft end portion 22, and a source of pressurized fluid, usually positioned on the vehicle to which the boom 27 is connected.

As discussed above, the body 12 with the grapple arms 136 and the cylinders 40 attached thereto is rotated as a unit relative to the shaft 20. Since the hoses 172, 174, 176 and 178 extend between the fluid gland 30 and the cylinders 40, and the hydraulic hose 170 extends between the fluid gland and the body 12, it is desirable to have the fluid gland rotate with the body to avoid twisting or pulling the hoses. However, it is not desirable to use the arrangement of the prior art which shows a fluid coupling block rigidly connected to the actuator body using bolts. With such an arrangement, the normal forces applied to the actuator body and shaft during operation under load can cause bending and axial movement of the body relative to the shaft, which is transmitted to the fluid coupling block. This results in fluid leaks and increased and uneven wear of the seals in the fluid coupling block, which ultimately result in fluid leakage and the need for expensive seal replacement.

With the present invention, the fluid gland 30 is loosely connected to the body 12 for rotation therewith, but rigid interconnection is intentionally avoided. To interconnect the fluid gland 30 with the body 12, the body has a radially outward projecting connection flange 180 fixedly attached to the body by circumferential welds W5 and W6 at a position toward the body first end 16. The fluid gland 30 has an connection member 182 fixedly attached thereto by a pair of threaded fasteners 184. The connection member 182 includes a cylindrical finger portion 186 which extends longitudinally through a circular receiving hole 188 in the connection flange 180. The receiving hole 188 has a diameter sufficiently larger than the diameter of the finger portion 186 to provide a sufficiently loose fit so that any bending forces on the body 12 which occurred during operation of the grapple arms 136 when carrying a load or otherwise performing work will not be transmitted to the fluid coupling 30 through the connection member 182. Any bending of the shaft 20 or the body 12 which is reflected on the connection flange 180 simply results in movement of the finger portion 186 within the receiving hole 188. This loose interconnection prevents any bending or axial movement of the body 12 relative to the shaft 20 from being transmitted from the body to the fluid gland 30, providing selective isolation of the fluid gland from the body, while allowing a rotational force to be transmitted from the body to the fluid gland as the body rotates on the shaft to produce rotation of the fluid gland on the shaft end portion 22 along with the body. The seals disposed in the fluid gland grooves 164 achieve a good, fluid-tight seal which is not affected by the bending or axial forces applied to the body 12, and the seals wear evenly with increased seal life.

Although bending and axial forces are not transmitted between the body 12 and the fluid gland 30, rotational movement of the body on the shaft 20 is transmitted by the connection flange 180 through the finger portion 186 to the fluid gland. Thus, the fluid gland 30 rotates smoothly with the body 12 to avoid the flexible fluid hoses 170, 172, 174, 176 and 178 from becoming twisted or entangled. The use of the connector member 182 and the connector flange 180 with the receiving hole 188 is one construction for the actuator 10 that mechanically isolates or disconnects the body 12 from the fluid gland 30 to permit axial movement of the body relative to the fluid gland. This arrangement also permits axially offset movement of the body relative to the fluid gland (i.e., pitching movement of the body relative to the axis of the shaft 20 when the actuator is not under load). These movements are permitted within at least the limited travel range that occurs during use of the actuator under normal loads and with normal wear of components, without transmitting axial or bending forces from the body to the fluid gland that would result from the axial and axially offset movement of the body if the body and the fluid gland were rigidly connected together. The actuator 10 may also be constructed to achieve this result without using the connection member 182 and the connection flange 180 to transmit rotational force from the body 12 to the fluid gland 30. For example, the inherent stiffness of the fluid hoses 170–178 may be used to cause the fluid gland 30 to rotate with the body 12.

The actuator 10 of the present invention permits hydraulic fluid to be supplied to the cylinders 40 and the piston 52 in a manner that will permit uninhibited rotation of the body 12 relative to the shaft 20 without the use of a fluid coupler with seals that leak or quickly wear out, and without loops of hydraulic hoses that can twist and become entangled with the boom 27 or snagged objects in the vicinity of the boom as the actuator is being operated.

It will be appreciated that, although specific embodiments of the invention have been described herein for purposes of illustration, various modifications may be made without departing from the spirit and scope of the invention. Accordingly, the invention is not limited except as by the appended claims.

I claim:

1. A fluid-powered rotary actuator attachable to a carrier and usable with a work implement having a selectively operable work implement actuator associated therewith, the work implement actuator having a pair of fluid ports for operation of the work implement actuator in response to selective application of pressurized fluid thereto from a source of pressurized fluid remote from the rotary actuator, comprising:

an attachment member configured for attachment to the carrier;

a tubular body having a longitudinal axis, and first and second ends, said body having a first attachment portion configured for attachment of the work implement thereto for rotation with said body, and a second attachment portion configured for attachment of the work implement actuator thereto for application of a counterforce upon actuation of the work implement actuator to operate the work implement;

a shaft extending longitudinally and generally coaxially within said body and having first and second end portions and an intermediate portion extending therebetween, said shaft first end portion being located toward said body first end and extending axially outward beyond said body first end, and being attached to said attachment member at a position axially outward of said body first end to prevent rotation of said shaft relative to said attachment member, said shaft first end portion having an outward surface portion, said shaft second end portion being located toward said body second end;

an annular fluid coupling rotatably mounted on said shaft first end portion between said attachment member and said body first end, said coupling having a central aperture defined by an inward surface portion extending circumferentially about said shaft outward surface portion with said shaft first end portion extending fully through said coupling central aperture, said coupling being freely rotatable on said shaft first end portion, at least one of said coupling inward surface portion or said shaft outward surface portion having first and second circumferentially extending fluid distribution channels formed therein, said coupling further having first and second fluid conduits with said coupling first conduit being in fluid communication with said first fluid distribution channel and said coupling second conduit being in fluid communication with said second fluid distribution channel, said coupling first and second conduits terminating in first and second fluid ports, respectively, each connectable to one of the pair of work implement actuator ports;

a first connection member attached to said coupling;

a second connection member attached to said body, said second connection member engaging said first connection member to transmit a rotational force on said coupling as said body rotates on said shaft to produce rotation of said coupling on said shaft first end portion with said body, without transmitting axial or bending forces between said body and said coupling;

a shaft first fluid conduit extending from a first source port through said shaft first end portion and terminating in a shaft first port in said shaft outward surface portion, said shaft first port being in alignment with said first fluid distribution channel and remaining in fluid communication therewith as said coupling rotates on said shaft first end portion, said first source port being connectable to the source of pressurized fluid;

a shaft second fluid conduit extending from a second source port through said shaft first end portion and terminating in a shaft second port in said shaft outward surface portion, said shaft second port being in alignment with said second fluid distribution channel and remaining in fluid communication therewith as said coupling rotates on said shaft first end portion, said second source port being connectable to the source of pressurized fluid;

a first annular shaft insert mounted coaxially within said body toward said body first end, said first shaft insert having a central aperture with said first shaft end portion extending therethrough, said first shaft insert further having a generally cylindrical outer surface and an axially inward annular end portion with a circular ball race formed thereon;

a second annular shaft insert mounted coaxially within said body toward said body second end, said second shaft insert having a central aperture with said second shaft end portion extending therethrough, said second shaft insert further having a generally cylindrical outer surface and an axially inward annular end portion with a circular ball race formed thereon;

a first body insert having a sleeve portion mounted coaxially within said body toward said body first end about said first shaft insert, said cylindrical outer surface of said first shaft insert being positioned within a central aperture of said first body insert, said first body insert having a circumferential flange portion projecting generally radially inward from said first body insert sleeve portion beyond said first shaft insert cylindrical outer surface to overlap said first shaft insert annular end portion, said first body insert flange portion being positioned axially inward of said first shaft insert ball race, said first body insert flange portion having a circular ball race formed thereon confronting and corresponding to said first shaft insert ball race to form a first set of races extending circumferentially about said first shaft end portion at a radial location inward of said cylindrical outer surface of said first shaft insert and rotatably supporting said body toward said body first end for rotational movement of said body relative to said shaft;

a second body insert having a sleeve portion mounted coaxially within said body toward said body second end about said second shaft insert, said cylindrical outer surface of said second shaft insert being positioned within a central aperture of said second body insert, said second body insert having a circumferential flange portion projecting generally radially inward from said second body insert sleeve portion beyond said second shaft insert cylindrical outer surface to overlap said second shaft insert annular end portion, said second body insert flange portion being positioned axially inward of said second shaft insert ball race, said second body insert flange portion having a circular ball race formed thereon confronting and corresponding to said second shaft insert ball race to form a second set of races extending circumferentially about said second shaft end portion at a radial location inward of said cylindrical outer surface of said second shaft insert and rotatably supporting said body toward said body second end for rotational movement of said body relative to said shaft;

a first seal positioned in a circumferential groove in said first shaft insert cylindrical outer surface to provide a fluid-tight seal between said first shaft insert and said first body insert;

a second seal positioned in a circumferential groove in said second shaft insert cylindrical outer surface to provide a fluid-tight seal between said second shaft insert and said second body insert;

a third seal axially positioned between said first and second fluid distribution channels and providing a fluid-tight seal between said coupling and said shaft first end portion;

fourth and fifth seals each being axially positioned with said first and second fluid distribution channels therebetween, said fourth and fifth seals providing fluid-tight seals between said coupling and said shaft first end portion;

one or more balls seated in each of said first and second sets of races;

a piston mounted for reciprocal longitudinal movement within said body in response to selective application of pressurized fluid thereto; and a torque-transmitting member mounted for reciprocal longitudinal movement within said body, said torque-transmitting member engaging said body and said shaft intermediate portion to translate longitudinal movement of said piston toward one of said body first or second ends into clockwise rotational movement of said body on said shaft, and longitudinal movement of said piston toward the other of said body first or second ends into counterclockwise rotational movement of said body on said shaft.

2. The actuator of claim 1 wherein said coupling has a circumferentially extending outward surface, with said coupling first and second fluid ports being positioned at said coupling outward surface.

3. The actuator of claim 1 wherein said attachment member has a central aperture and said shaft first end portion extends therethrough and terminates in a shaft end surface, and said shaft first and second source ports are positioned at said shaft end surface.

4. The actuator of claim 1 wherein one of said first or second connection members has a connector finger projecting generally parallel to said body axis toward the other of said first or second connection member, and the other of said first or second connection member has an aperture loosely receiving a portion of said connector finger therein to transmit said rotational force through said first connector finger to said coupling as said body rotates, said connection member aperture being sized sufficiently larger than said finger portion to permit unrestricted relative axial movement therebetween and free movement of said finger portion within said connector aperture resulting from axial movement of said body on said shaft or bending of said shaft or said body during operation.

5. A fluid-powered rotary actuator attachable to a carrier and usable with a work implement having a selectively operable work implement actuator associated therewith, the work implement actuator having a pair of fluid ports for operation of the work implement actuator in response to selective application of pressurized fluid thereto from a source of pressurized fluid remote from the rotary actuator, comprising:

an attachment member configured for attachment to the carrier;

a body having a longitudinal axis, and first and second ends, said body having a first attachment portion configured for attachment of the work implement thereto for rotation with said body, and a second attachment portion configured for attachment of the work implement actuator thereto for application of a counterforce upon actuation of the work implement actuator to operate the work implement;

a shaft extending longitudinally and generally coaxially within said body and having first and second end portions and an intermediate portion extending therebetween, said shaft first end portion being located toward said body first end and extending axially outward beyond said body first end, and being held against rotation by said attachment member at a position axially outward of said body first end, said shaft first end portion having an outward surface portion;

a fluid coupling rotatably mounted on said shaft first end portion between said attachment member and said body first end, said coupling having an aperture defined by an inward surface portion extending circumferentially about said shaft outward surface portion with said shaft first end portion extending into said coupling aperture, said coupling being freely rotatable relative to said shaft first end portion, at least one of said coupling inward surface portion or said shaft outward surface portion having first and second circumferentially extending fluid distribution channels formed therein, said coupling further having first and second fluid conduits with said coupling first conduit being in fluid communication with said first fluid distribution channel and said coupling second conduit being in fluid communication with said second fluid distribution channel, said coupling first and second conduits terminating in first and second fluid ports, respectively, each connectable to one of the pair of work implement actuator ports;

an interconnection member transmitting a rotational force on said coupling as said body rotates on said shaft to produce rotation of said coupling on said shaft first end portion with said body while retaining said body disconnected from said coupling to permit axial and axially offset movement of said body relative to said coupling within at least a limited range during normal operation of the fluid-powered rotary actuator without transmitting axial or bending forces from said body to said coupling;

a shaft first fluid conduit extending from a first source port through said shaft first end portion and terminating in a shaft first port in said shaft outward surface portion, said shaft first port being in alignment with said first fluid distribution channel and remaining in fluid communication therewith as said coupling rotates on said shaft first end portion, said first source port being connectable to the source of pressurized fluid;

a shaft second fluid conduit extending from a second source port through said shaft first end portion and terminating in a shaft second port in said shaft outward surface portion, said shaft second port being in alignment with said second fluid distribution channel and remaining in fluid communication therewith as said coupling rotates on said shaft first end portion, said second source port being connectable to the source of pressurized fluid;

a support member rotatably supporting said body for rotational movement relative to said shaft;

a piston mounted for reciprocal longitudinal movement within said body in response to selective application of pressurized fluid thereto; and a torque-transmitting member mounted for reciprocal longitudinal movement within said body, said torque-transmitting member engaging said body and said shaft to translate longitudinal movement of said piston toward one of said body first or second ends into clockwise rotational movement of said body on said shaft, and longitudinal movement of said piston toward the other of said body first or second ends into counterclockwise rotational movement of said body on said shaft.

6. The actuator of claim 5, wherein said interconnection member includes:

a first connection member attached to said coupling; and a second connection member attached to said body, said second connection member engaging said first connection member to transmit a rotational force on said coupling as said body rotates on said shaft to produce rotation of said coupling on said shaft first end portion with said body, without transmitting axial or bending forces between said body and said coupling.

7. The actuator of claim 6 wherein one of said first or second connection members has a connector finger projecting generally parallel to said body axis toward the other of said first or second connection member, and the other of said first or second connection member has a receiver loosely receiving a portion of said connector finger therein to transmit said rotational force through said first connector finger to said coupling as said body rotates, said receiver being sized sufficiently larger than said finger portion to permit unrestricted relative axial movement therebetween and free movement of said finger portion within said receiver resulting from axial movement of said body on said shaft or bending of said shaft or said body during operation.

8. The actuator of claim 5 wherein said coupling has a circumferentially extending outward surface, with said coupling first and second fluid ports being positioned at said coupling outward surface.

9. The actuator of claim 5 wherein said attachment member has a central aperture and said shaft first end portion extends therethrough and terminates in a shaft end surface, and said shaft first and second source ports are positioned at said shaft end surface.

10. A fluid-powered rotary tool assembly attachable to a carrier, comprising:

a work implement;

a selectively operable work implement actuator having a first end connected to said work implement and a second end, said work implement actuator having first and second fluid ports for operation of said work implement actuator in response to selective application of pressurized fluid thereto from a source of pressurized fluid remote from the tool assembly;

an attachment member configured for attachment to the carrier;

a body having a longitudinal axis, and first and second ends, said body having a first attachment portion to which said work implement is attached for rotation with said body, and a second attachment portion to which said work implement actuator second end is attached for application of a counterforce upon actuation of said work implement actuator to operate said work implement;

a shaft extending longitudinally and generally coaxially within said body and having first and second end portions, said shaft first end portion being located toward said body first end and extending axially outward beyond said body first end, and being held against rotation by said attachment member at a position axially outward of said body first end, said shaft first end portion having an outward surface portion;

an annular fluid coupling rotatably mounted on said shaft first end portion between said attachment member and said body first end, said coupling having a central aperture defined by an inward surface portion extending circumferentially about said shaft outward surface portion with said shaft first end portion extending fully through said coupling central aperture, said coupling being freely rotatable relative to said shaft first end portion, at least one of said coupling inward surface portion or said shaft outward surface portion having first and second circumferentially extending fluid distribution channels formed therein, said coupling further having first and second fluid conduits with said coupling first conduit being in fluid communication with said first fluid distribution channel and said coupling second conduit being in fluid communication with said second fluid distribution channel, said coupling first conduit terminating in a coupling first fluid port in fluid communication with said work implement actuator first fluid port and said coupling second conduit terminating in a coupling second fluid port in fluid communication with said work implement actuator second fluid port;

an interconnection member transmitting a rotational force on said coupling as said body rotates on said shaft to produce rotation of said coupling on said shaft first end portion with said body while retaining said body disconnected from said coupling to permit axial and axially offset movement of said body relative to said coupling within at least a limited range during normal operation of the fluid-powered rotary actuator without transmitting axial or bending forces from said body to said coupling;

a shaft first fluid conduit extending from a first source port through said shaft first end portion and terminating in a shaft first port in said shaft outward surface portion, said shaft first port being in alignment with said first fluid distribution channel and remaining in fluid communication therewith as said coupling rotates on said shaft first end portion, said first source port being connectable to the source of pressurized fluid;

a shaft second fluid conduit extending from a second source port through said shaft first end portion and terminating in a shaft second port in said shaft outward surface portion, said shaft second port being in alignment with said second fluid distribution channel and remaining in fluid communication therewith as said coupling rotates on said shaft first end portion, said second source port being connectable to the source of pressurized fluid;

a support member rotatably supporting said body for rotational movement relative to said shaft;

a piston mounted for reciprocal longitudinal movement within said body in response to selective application of pressurized fluid thereto; and a torque-transmitting member mounted for reciprocal longitudinal movement within said body, said torque-transmitting member engaging said body and said shaft to translate longitudinal movement of said piston toward one of said body first or second ends into clockwise rotational movement of said body on said shaft, and longitudinal movement of said piston toward the other of said body first or second ends into counterclockwise rotational movement of said body on said shaft.

11. The tool assembly of claim 10, wherein said interconnection member includes:

a first connection member attached to said coupling; and a second connection member attached to said body, said second connection member engaging said first connection member to transmit a rotational force on said coupling as said body rotates on said shaft to produce rotation of said coupling on said shaft first end portion with said body, without transmitting axial or bending forces between said body and said coupling.

12. The tool assembly of claim 11 wherein one of said first or second connection members has a connector finger projecting generally parallel to said body axis toward the other of said first or second connection member, and the other of said first or second connection member has a receiver loosely receiving a portion of said connector finger therein to transmit said rotational force through said first connector finger to said coupling as said body rotates, said connection receiver being sized sufficiently larger than said finger portion to permit unrestricted relative axial movement therebetween and free movement of said finger portion within said receiver resulting from axial movement of said body on said shaft or bending of said shaft or said body during operation.

13. The tool assembly of claim 10 wherein said coupling has a circumferentially extending outward surface, with said coupling first and second fluid ports being positioned at said coupling outward surface.

14. The tool assembly of claim 10 wherein said attachment member has a central aperture and said shaft first end portion extends therethrough and terminates in a shaft end surface, and said shaft first and second source ports are positioned at said shaft end surface.

15. A fluid-powered rotary actuator attachable to a carrier and usable with a work implement having a selectively operable work implement actuator associated therewith, the work implement actuator having a pair of fluid ports for operation of the work implement actuator in response to selective application of pressurized fluid thereto from a source of pressurized fluid remote from the rotary actuator, comprising:

an attachment member configured for attachment to the carrier;

a tubular body having a longitudinal axis, and first and second ends, said body having a first attachment portion configured for attachment of the work implement thereto for rotation with said body, and a second attachment portion configured for attachment of the work implement actuator thereto for application of a counterforce upon actuation of the work implement actuator to operate the work implement;

a shaft extending longitudinally and generally coaxially within said body and having first and second end portions and an intermediate portion extending therebetween, said shaft first end portion being located toward said body first end and extending axially outward beyond said body first end, and being attached to said attachment member at a position axially outward of said body first end to prevent rotation of said shaft relative to said attachment member, said shaft first end portion having an outward surface portion, said shaft second end portion being located toward said body second end;

an annular fluid coupling rotatably mounted on said shaft first end portion between said attachment member and said body first end, said coupling having a central aperture defined by an inward surface portion extending circumferentially about said shaft outward surface portion with said shaft first end portion extending fully through said coupling central aperture, said coupling being freely rotatable on said shaft first end portion, at least one of said coupling inward surface portion or said shaft outward surface portion having first and second circumferentially extending fluid distribution channels formed therein, said coupling further having first and second fluid conduits with said coupling first conduit being in fluid communication with said first fluid distribution channel and said coupling second conduit being in fluid communication with said second fluid distribution channel, said coupling first and second conduits terminating in first and second fluid ports, respectively, each connectable to one of the pair of work implement actuator ports;

an interconnection member transmitting a rotational force on said coupling as said body rotates on said shaft to produce rotation of said coupling on said shaft first end portion with said body, without transmitting axial or bending forces between said body and said coupling;

a shaft first fluid conduit extending from a first source port through said shaft first end portion and terminating in a shaft first port in said shaft outward surface portion, said shaft first port being in alignment with said first fluid distribution channel and remaining in fluid communication therewith as said coupling rotates on said shaft first end portion, said first source port being connectable to the source of pressurized fluid;

a shaft second fluid conduit extending from a second source port through said shaft first end portion and terminating in a shaft second port in said shaft outward surface portion, said shaft second port being in alignment with said second fluid distribution channel and remaining in fluid communication therewith as said coupling rotates on said shaft first end portion, said second source port being connectable to the source of pressurized fluid;

a first annular shaft insert mounted coaxially within said body toward said body first end, said first shaft insert having a central aperture with said first shaft end portion extending therethrough, said first shaft insert further having a generally cylindrical outer surface and an axially inward annular end portion with a circular ball race formed thereon;

a second annular shaft insert mounted coaxially within said body toward said body second end, said second shaft insert having a central aperture with said second shaft end portion extending therethrough, said second shaft insert further having a generally cylindrical outer surface and an axially inward annular end portion with a circular ball race formed thereon;

a first body insert having a sleeve portion mounted coaxially within said body toward said body first end about said first shaft insert, said cylindrical outer surface of said first shaft insert being positioned within a central aperture of said first body insert, said first body insert having a circumferential flange portion projecting generally radially inward from said first body insert sleeve portion beyond said first shaft insert cylindrical outer surface to overlap said first shaft insert annular end portion, said first body insert flange portion being positioned axially inward of said first shaft insert ball race, said first body insert flange portion having a circular ball race formed thereon confronting and corresponding to said first shaft insert ball race to form a first set of races extending circumferentially about said first shaft end portion at a radial location inward of said cylindrical outer surface of said first shaft insert and rotatably supporting said body toward said body first end for rotational movement of said body relative to said shaft;

a second body insert having a sleeve portion mounted coaxially within said body toward said body second end about said second shaft insert, said cylindrical outer surface of said second shaft insert being positioned within a central aperture of said second body insert, said second body insert having a circumferential flange portion projecting generally radially inward from said second body insert sleeve portion beyond said second shaft insert cylindrical outer surface to overlap said second shaft insert annular end portion, said second body insert flange portion being positioned axially inward of said second shaft insert ball race, said second body insert flange portion having a circular ball race formed thereon confronting and corresponding to said second shaft insert ball race to form a second set of races extending circumferentially about said second shaft end portion at a radial location inward of said cylindrical outer surface of said second shaft insert and rotatably supporting said body toward said body second end for rotational movement of said body relative to said shaft;

a first seal positioned in a circumferential groove in said first shaft insert cylindrical outer surface to provide a fluid-tight seal between said first shaft insert and said first body insert;

a second seal positioned in a circumferential groove in said second shaft insert cylindrical outer surface to provide a fluid-tight seal between said second shaft insert and said second body insert;

a third seal axially positioned between said first and second fluid distribution channels and providing a fluid-tight seal between said coupling and said shaft first end portion;

fourth and fifth seals each being axially positioned with said first and second fluid distribution channels therebetween, said fourth and fifth seals providing fluid-tight seals between said coupling and said shaft first end portion;

one or more balls seated in each of said first and second sets of races;

a piston mounted for reciprocal longitudinal movement within said body in response to selective application of pressurized fluid thereto; and a torque-transmitting member mounted for reciprocal longitudinal movement within said body, said torque-transmitting member engaging said body and said shaft intermediate portion to translate longitudinal movement of said piston toward one of said body first or second ends into clockwise rotational movement of said body on said shaft, and longitudinal movement of said piston toward the other of said body first or second ends into counterclockwise rotational movement of said body on said shaft.

16. The actuator of claim 15 wherein said coupling has a circumferentially extending outward surface, with said coupling first and second fluid ports being positioned at said coupling outward surface.

17. The actuator of claim 15 wherein said attachment member has a central aperture and said shaft first end portion extends therethrough and terminates in a shaft end surface, and said shaft first and second source ports are positioned at said shaft end surface.

* * * * *